US005316118A

United States Patent [19]

Ibarrola et al.

[11] Patent Number: 5,316,118

[45] Date of Patent: May 31, 1994

[54] DEVICE FOR OBTAINING MECHANICAL CHARACTERISTIC OF COINS

[75] Inventors: Jesus E. Ibarrola; Jose L. P. Insausti, both of Pamplona, Spain

[73] Assignee: Azkoyen Industrial, S.A., Peralta, Spain

[21] Appl. No.: 839,762

[22] PCT Filed: Aug. 6, 1991

[86] PCT No.: PCT/ES91/00051

§ 371 Date: Jun. 4, 1992

§ 102(e) Date: Jun. 4, 1992

[87] PCT Pub. No.: WO92/02905

PCT Pub. Date: Feb. 20, 1992

[30] Foreign Application Priority Data

Aug. 8, 1990 [ES] Spain ..... 9002145
Jul. 30, 1991 [ES] Spain ..... 9101787
Jul. 30, 1991 [ES] Spain ..... 9101789

[51] Int. Cl.[5] ..... G07D 5/06

[52] U.S. Cl. ..... 194/317; 33/790

[58] Field of Search ..... 194/317, 339; 33/788, 33/789, 790, DIG. 13

[56] References Cited

U.S. PATENT DOCUMENTS 3,878,711 4/1975 Randolph ..... 33/788
5,062,518 11/1991 Chitty et al. ..... 194/317
5,085,309 2/1992 Adamson et al. ..... 194/317

FOREIGN PATENT DOCUMENTS 0184393 6/1986 European Pat. Off. ..... G07F 3/02
0323396 7/1989 European Pat. Off. ..... G07F 3/00
0360506 3/1990 European Pat. Off. ..... G07F 3/02
2825094 12/1979 Fed. Rep. of Germany ..... 194/317
747958 4/1933 France .
8300400 2/1983 PCT Int'l Appl. ..... 194/3/7

*Primary Examiner*—F. J. Bartuska
*Attorney, Agent, or Firm*—Rothwell, Figg, Ernst & Kurz

[57] ABSTRACT

A device and procedure for obtaining the mechanical characteristics of coins includes an element onto which coins pass which element is elastically deformable under the weight of the coins. This elastically deformable element has sensors to detect an electric signal corresponding to the deformation of the element from which can be obtained the inherent mechanical characteristics sought after in the coin. From the signals produced by the coin rolling along the aforementioned element, which can be in the form of a beam, the device uses frequency analysis to determine a parameter which is representative of the mechanical elasticity of the coin. This parameter is then compared to various stored data to determine whether or not the coin is authentic.

14 Claims, 7 Drawing Sheets

DEVICE FOR OBTAINING MECHANICAL CHARACTERISTIC OF COINS

The invention herein described refers to a device used to ascertain the mechanical characteristics of coins, for their application to coin selectors or verifiers used in coin operated machines.

Electronic selectors are known to obtain certain characteristics of coins, fundamentally electromagnetic and measurement characteristics through electro optical, inductive and, to a lesser extent, capacitive sensors.

With these types of selectors it is possible to obtain electric signals which bear a relation, for example, to the diameter of the coins, to the thickness, to the electric conductivity, to the magnetic permeability etc. The electric signals obtained are then compared with predetermined values so as to identify the coins and their ensuing acceptance or rejection.

Electronic selectors of the kind commented on have been described, for example, in British patent 2,151,062, the U.S. Pat. No. 8,403,015, and Spanish patents 540,860, 540,229 and 555,181.

Additionally, there are selectors which detect mechanical characteristics of coins, such as, volume, elasticity, etc. By analysing the impact of the coin on a beam or by determining the weight of the coins.

Selectors, in which the impact of the coins is analysed, have been described, for example, in the Swiss patent numbers 645,201 and 647,608, in the Spanish patent 514,234 and in the British patent 2173624. The measurement of the impact of the coins is not precise, as the impact brings about irregular effects which are not very repetitive, depending on the condition of the edge of the coin, the angle of incidence, the types of materials of coins and the anvil or sensor plate which receives the impact, etc.

Selectors which measure the weight of the coins have been described in the Swiss patent 624,500, the British patent 2010559 and the French patent 2335005.

The Swiss patent 624,500, refers to a coin verification device for automatic vending machines based on the measurement of the weight of the coins by means of a weighing device or electronic scale.

The British patent 2,015,559 refers to an apparatus for detecting the value of a coin, in combination with coin dimension detector mechanisms includes a weight sensor made up of a mobile plate with a phototransistor incorporated which detects the position of this plate. To determine the weight of the coin it is necessary for the coin to be retained.

The French patent 2335005 refers to a coin controlling device, which includes a mechanical weighing device in the form of a roman scale which checks if the coin is of the minimum weight.

The device which is the subject of the present invention, corresponds to the latter of the above mentioned sensors which is based on the measurement of the weight of the coins.

The device subject of the invention weighs the coins by detecting the deformations tolerated by an elastically deformable element, on which the coins fall.

In the Swiss patent 624,500 the weight of the coins is measured by detecting the displacement of a mobile element, on which the coins fall. In the device subject of the invention there is no such mobile element, but rather a deformable elastic element. The weight sensor used is different.

In comparation with the British patent 2010559, the detector subject of the present invention does not need to retain the coin in order to measure its weight. In other words, with a static measurement, the device subject of the invention realizes a dynamic measurement. On the other hand, the element with which the weight of the coins is effected, is of a completely different nature.

Finally, the device subject of the invention uses a weighing element which is different from that of the French patent 2,335,005, which on the other hand, only checks if the coin possesses the minimum weight, that is to say, it detects the possible lack of weight but not the correct weight of the coin. Nor does it provide electric signals for later checks and comparisons.

The present invention incorporates a device for ascertaining mechanical characteristics of coins, applicable to coin selectors, which enables the identification of coins on the basis of detecting the deformations tolerated by a deformable elastic element, preferably of a metallic substance on which the coin rolls, the deformations produced on this element will depend on the weight of the coin and on the position of the coin at each stage in relation to the deformable element.

To measure the deformations of the deformable element any of the direct or indirect procedures, applicable to the measurement of deformations on materials, may be used.

According to a preferred form of procedure, the elastically deformable element is composed of a beam with at least one of its ends embedded. This beam determines the route along which the coin will roll, bringing about the deformation of the beam to an extent which will depend on the weight of the coin and on its position in relation to the point of incasement of the beam. The beam also includes a measurer of determinations.

This device will form part of a coin selector and the deformable elastic element will define a path along which the coins will pass on their way through the selector.

The aforementioned may be made up of an elastic band which is embedded at one end and has the other overhanging.

The measurer of deformations may consist of an extensometer gage attached to the metallic strip, near its incasement. This measurer may also consist of a displacement sensing device which measures the deflection of the point of maximum deformation on the beam.

The strip which defines the elastically deformable element may be attached at its free end. By way of variation, the beam or elastic band may be embedded at both ends.

In addition to the beam which defines the elastically deformable element, an upper stretch may be included which will define the route along which the coins will roll, and a lower stretch which will serve as an anchorage for the body of the selector. At the very least, the first stretch mentioned will have a slight inclination so as to induce the rolling of the coins.

The invention also includes a procedure for ascertaining mechanical characteristics of coins by means of the device herein described.

The signal obtained from the impact and rolling of the coin on the elastically deformable element, the subject of the invention, includes two fields which are clearly distinguishable by the different activation caused in both (frequency fields), one of these fields corresponds to the moment of impact of the coin on the elastically deformable element and the other corresponds to the variable signal which is produced during the rolling of the coin along the aforementioned element and wich depends on the weight of the coin and its position throughout.

The procedure is based on the degree of impact of the coin on the deformable elastic element in order to determine, by means of a specific frequency analysis, a parameter which is representative of the mechanical elasticity of the coin. For this purpose a measurement of the upper harmonics of the impact signal is made, the content of this measurement representing the mechanical elasticity of the coin.

The invention therefore uses frequency analysis techniques with the aim of analysing the resonance frequencies in relation to the type of impact. If the coin is high in elasticity, the frequencies tend to be proportionately more active than if the coin is low elasticity, in which case the coin acts like a shock absorber. Therefore, analysing the harmonic content of the signal produced by the impact, it is possible to obtain a measurement which is representative of the elasticity of the coin.

To carry out a measurement of the frequency occurring on impact, a parameter depending on the mechanical elasticity of the coins is used and stored in the coin selector memory and used later to identify the coins, together with other parameters representative of, for example, weight, alloy, dimensions, etc.

The frequency analysis of the impact described can be carried out by means of a circuit which includes: an amplifier, responsible for increasing the level of the signal supplied to the impact sensor; an analogic pitch band filter circuit, syntonised with the normal frequency of the sought after elasticity, an analogic-digital converter and a microprocesor. The analogic filter may be of a fixed or variable pitch-band frequency depending on whether one or various frequency ranges are involved. Furthermore, as an alternative to the analogic filter, it is possible to use digital filtering, incorporated in the microprosessor used in the coin selector.

If one should wish to incorporate a measurement of characteristic vibrations present during the rolling or displacement of the coin along the beam, it is possible to use a circuit similar to the one previously described.

As an alternative, it is also possible to use a single analogic filter, obtaining different frequency tuning during variable tuning or line switching techniques (usually tuning capacitors) controlled by the processor.

The characteristics of the invention as they are presented in the claims, are more easily understood from the following description, made with reference to the attached drawings in which a possible form of procedure shown, offered by way of example but by no means meant to be limiting.

Figure 3:
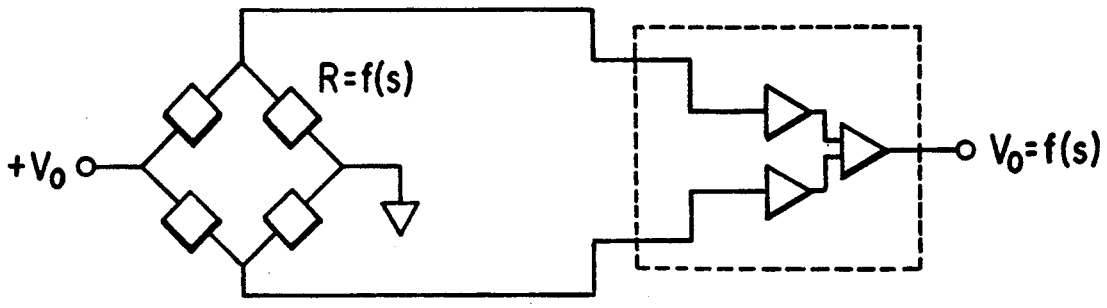

FIG. 3 corresponds to a possible circuit which can provide currents which are proportional to the deformation of the elastically deformable element.

Figure 4:
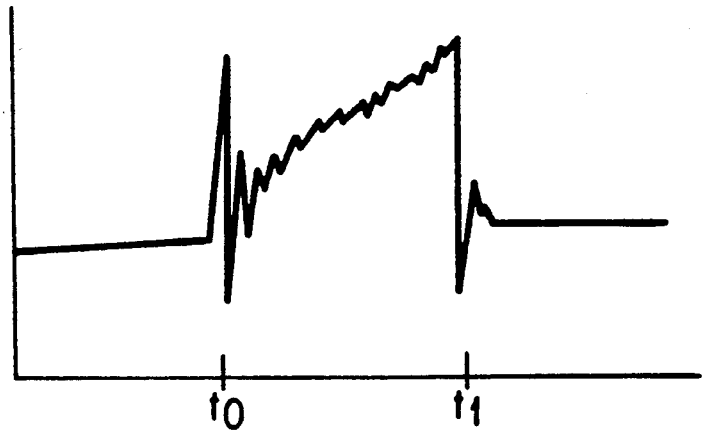

FIG. 4 is a diagram of the electric signal derived from the deformations of the elastically deformable element during the rolling of the coin.

Figure 5:
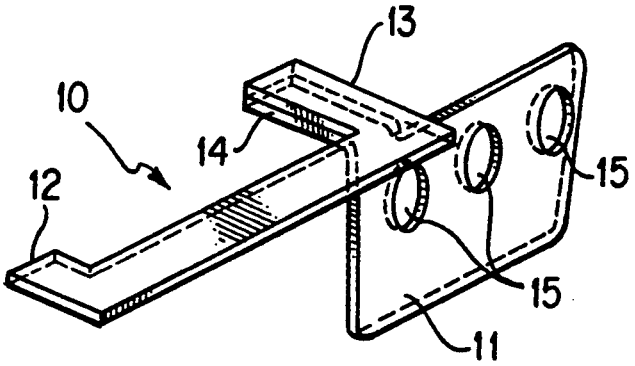

FIG. 5 shows a perspective of a possible effect on the deformable elastic element.

Figure 6:
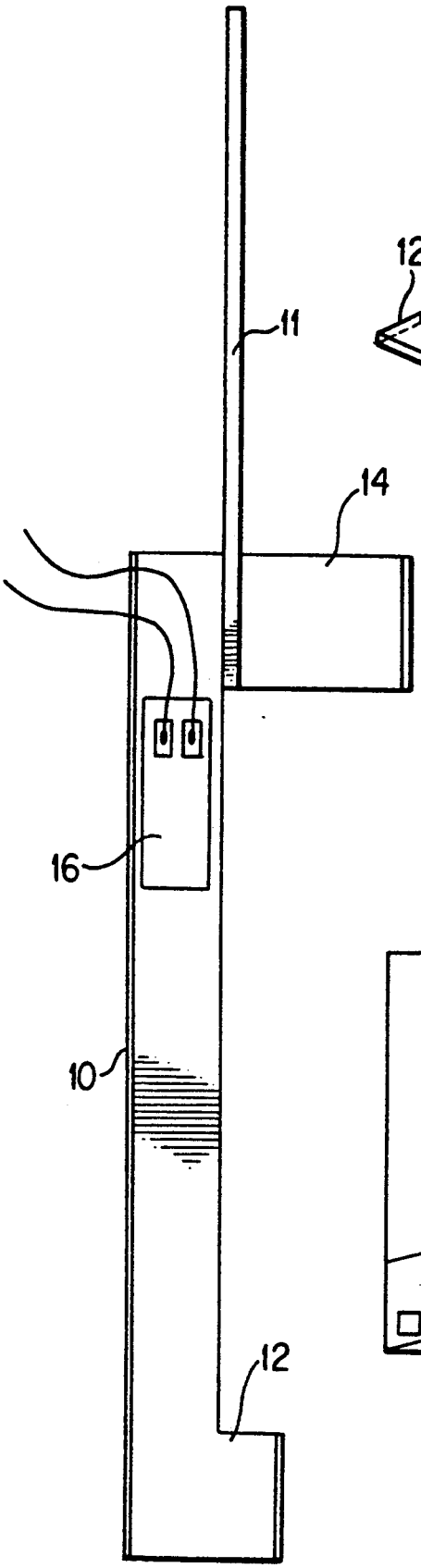

FIG. 6 shows a lower plan of the element in FIG. 5.

Figure 7:
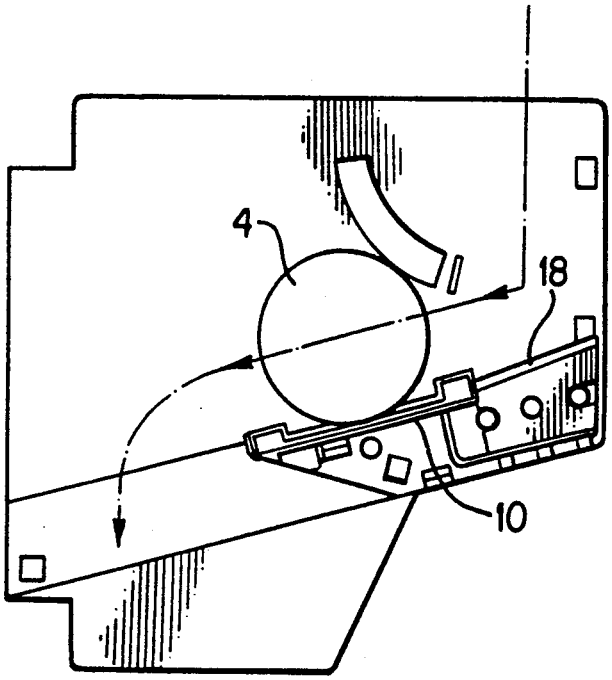

FIG. 7 shows a frontal elevation of the internal part of a coin selector which includes the deformable elastic element of FIGS. 5 and 6.

Figure 8:
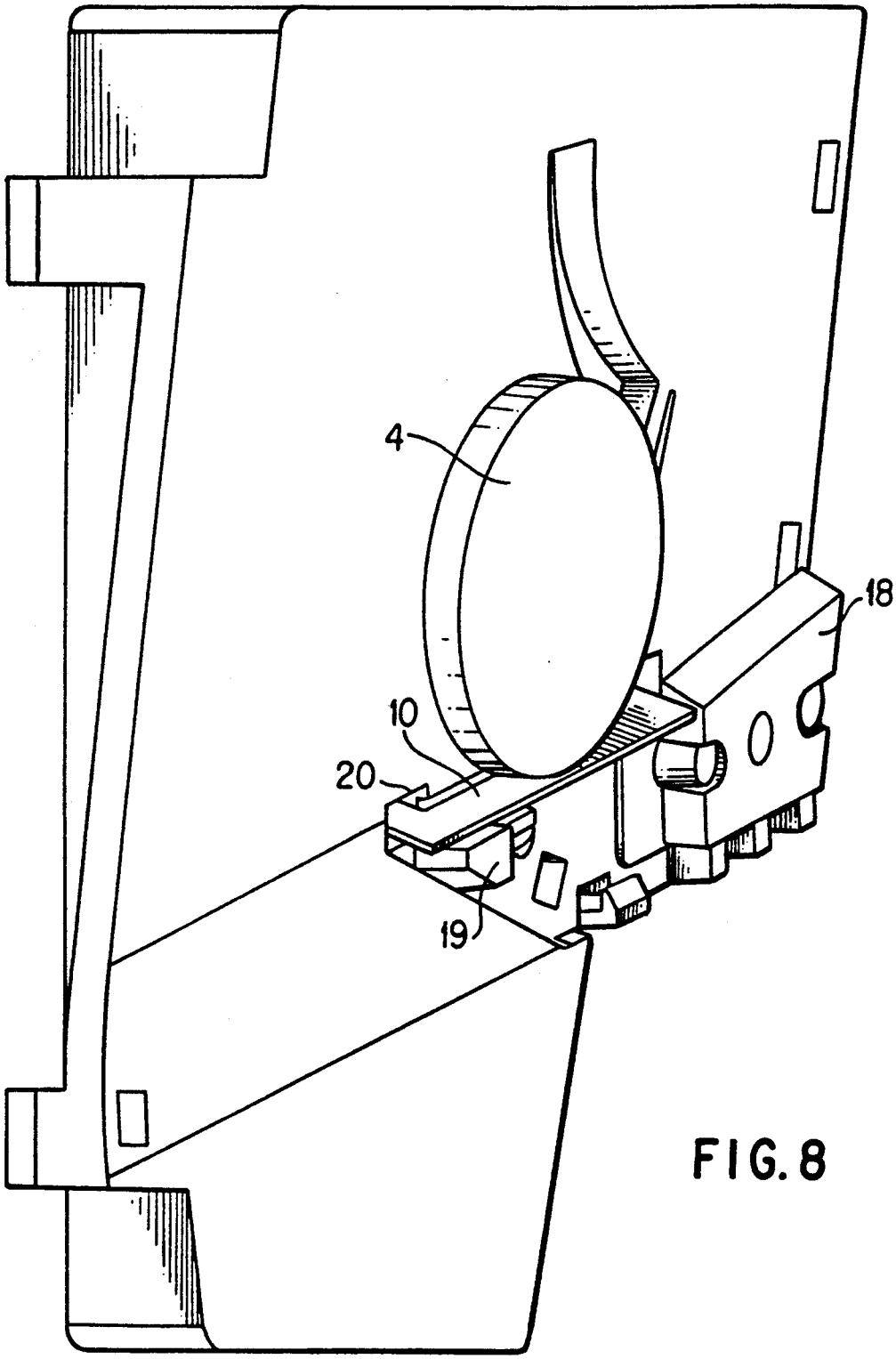

FIG. 8 offers a perspective of the performance of FIG. 7.

Figure 9:
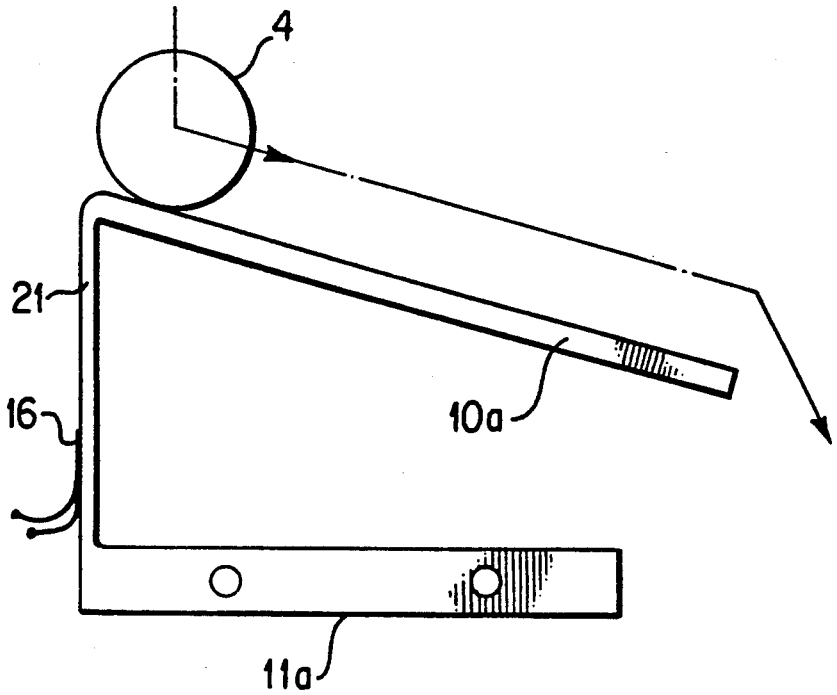
Figure 10:
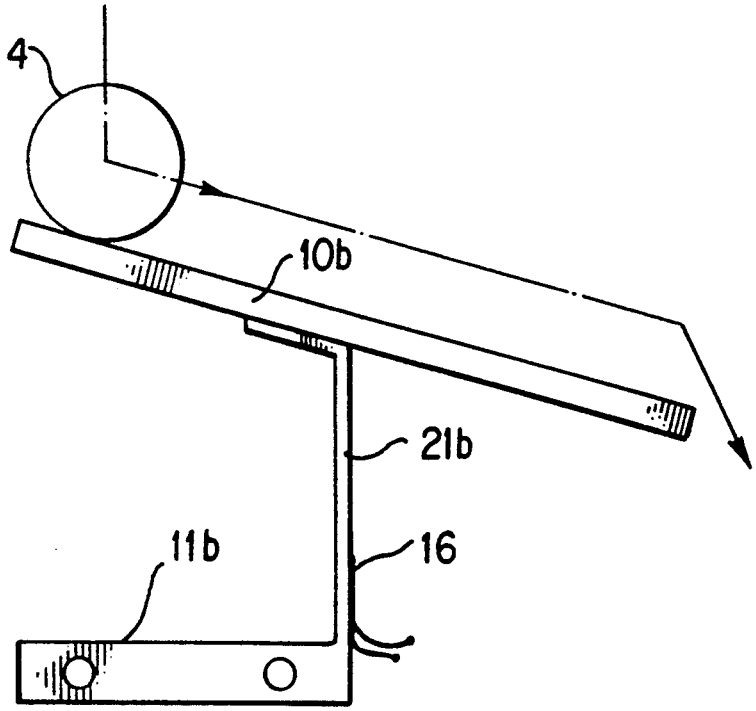

FIGS. 9 and 10 show a lateral elevation, of other effects of the elastically deformable element.

Figure 11:
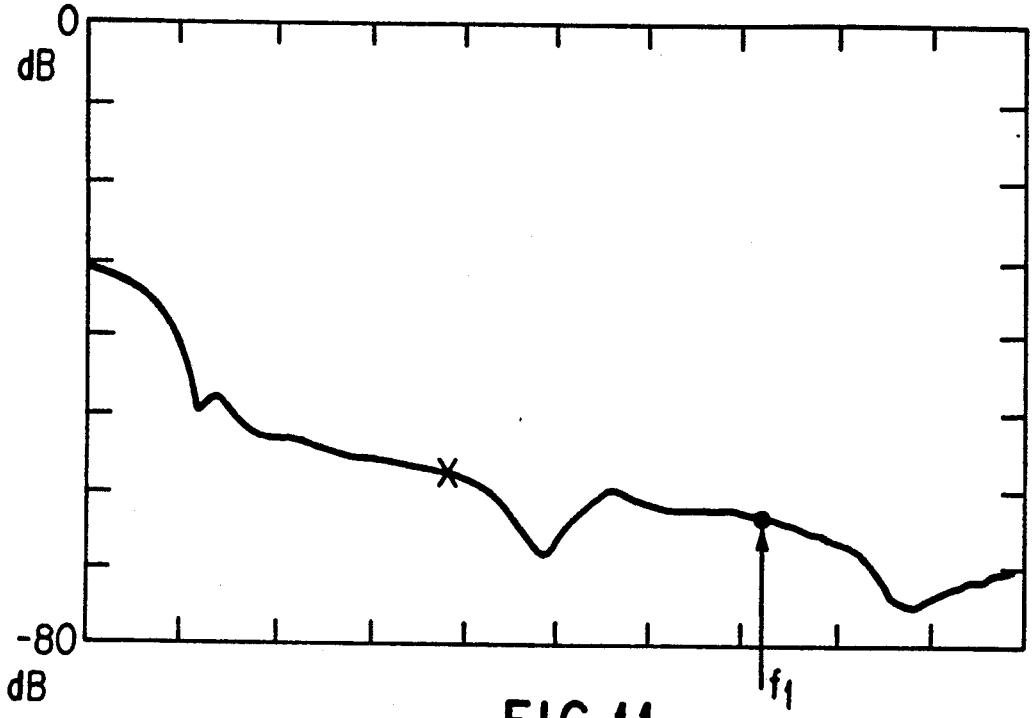
Figure 12:
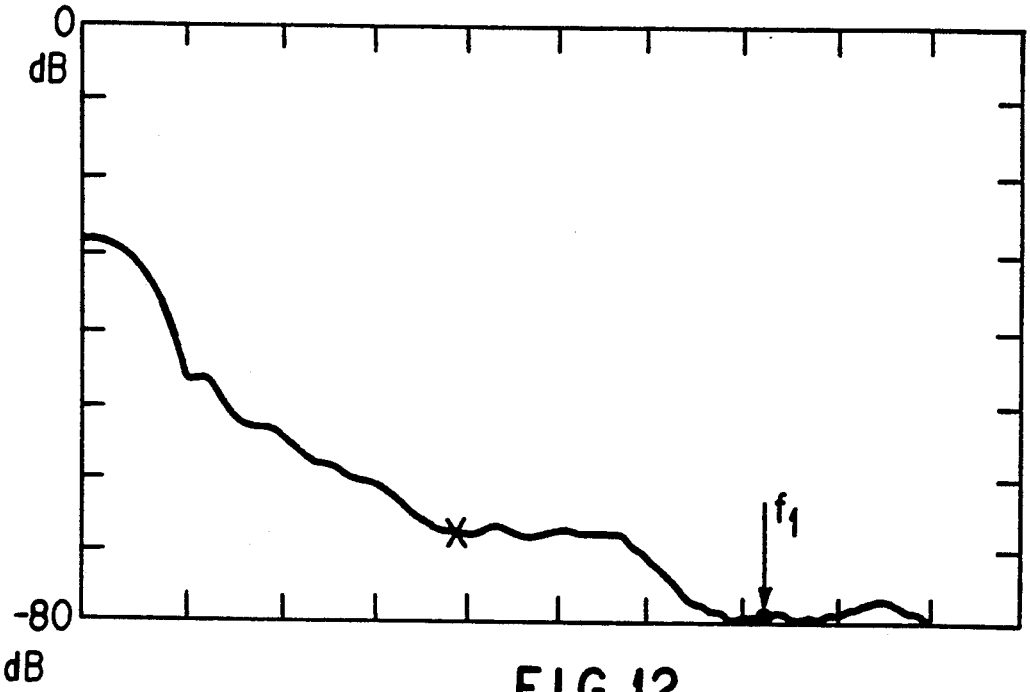

FIGS. 11 and 12 correspond to other graphs, which represent the frequency content of the impact of two coins, of the same dimensions, but of different elasticity, the graph of FIG. 11 corresponds to a legal tender coin and FIG. 12 to a fake coin.

Figure 13:
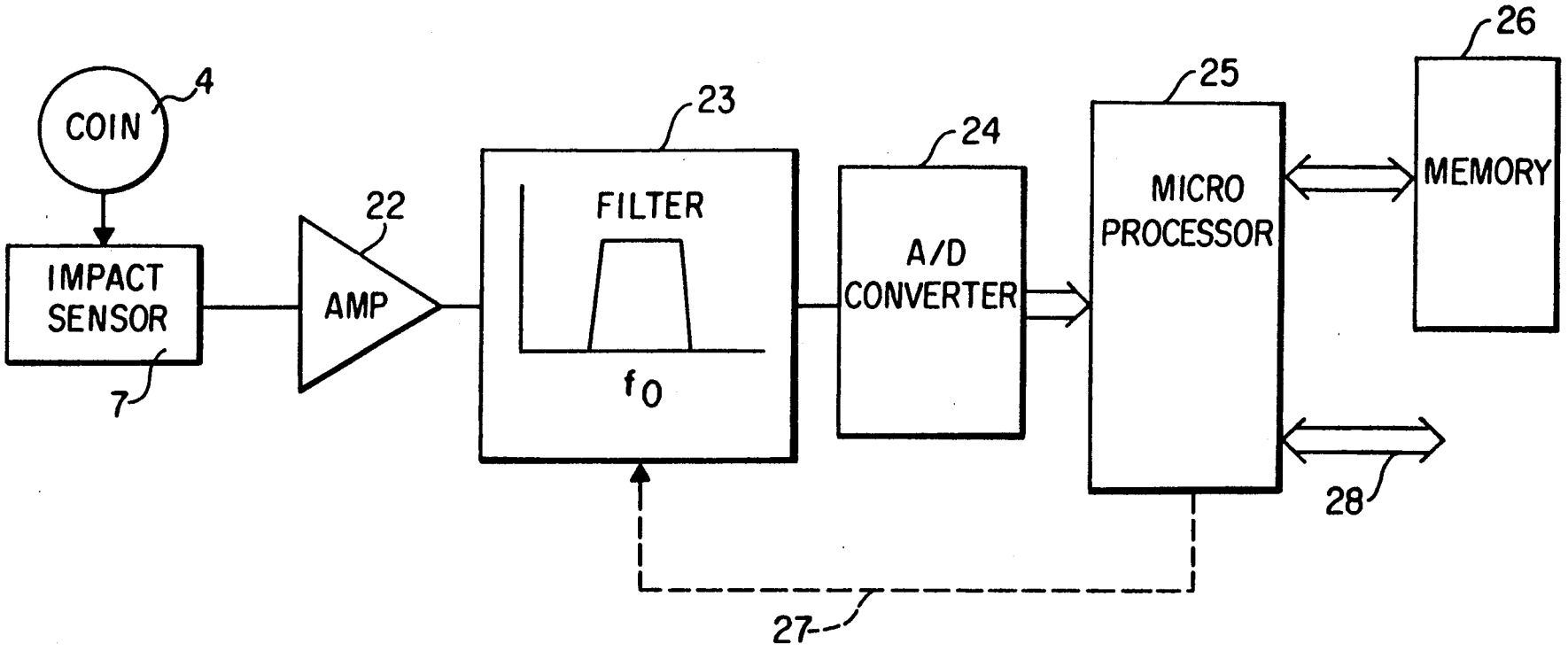

FIG. 13 is a block diagram of a circuit which allows the process to be carried out.

Figure 1:
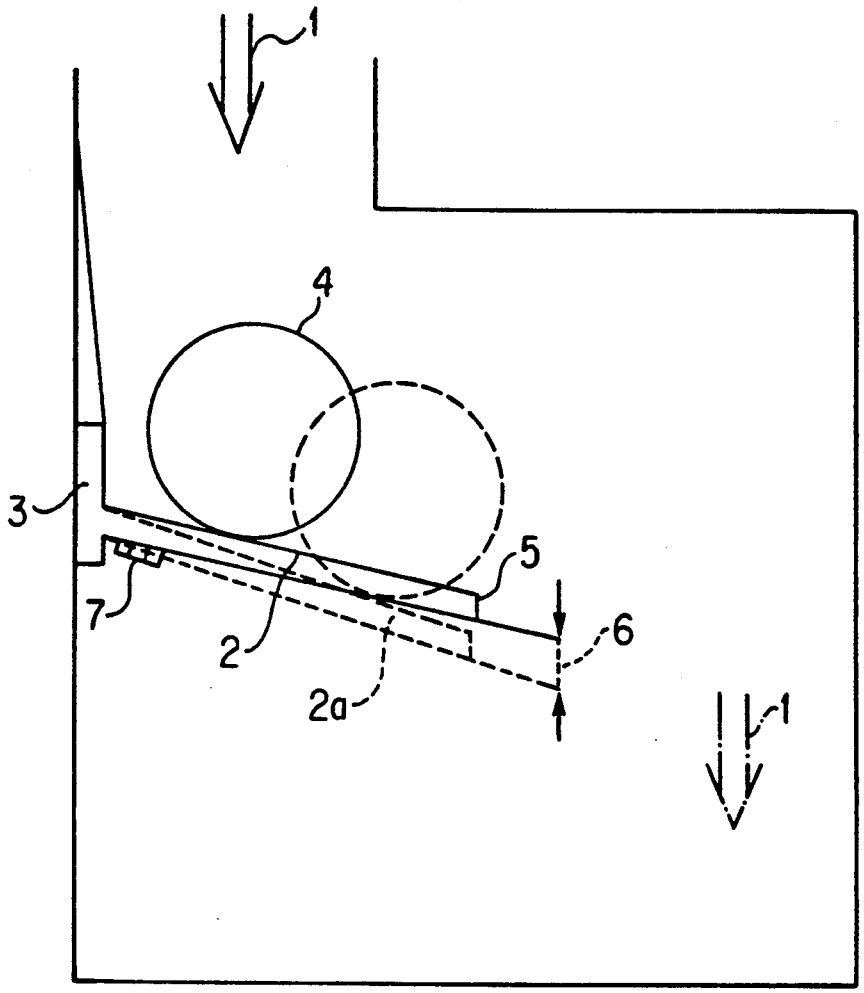
FIG. 1 shows a schematic drawing of a device for ascertaining mechanical characteristics of coins, made up of a beam embedded at one extreme.

In FIG. 1 the deflections marked number 1, indicate the route followed by coin, for example, within the coin selector. A stretch of this route is defined by the device which is the subject of the invention and incorporates an elastically deformable beam (2) which is incased at one extreme (3) and overhanging at the other extreme. This beam, along which the coins (4) will roll, may be of a metallic plate.

As a coin (4) rolls along the embedded plate (4) a deformation is produced. This deformation will reach a maximum value when the coin (4) arrives at the free end (5) of the plate or beam (2), at which time the plate will be in a position represented by the dotted lines and reference numbered 2*a*. The maximum deformation corresponds to the deflection (6).

The deformation of line 5, will always be in relation to the weight of the coin (4) and to its position throughout the length of the beam (2). To measure these deformations it is possible to use extensometric gages (7) attached near the incasement of the beam, without this technique necessarily excluding other possible procedures or systems of measuring deformations in the plate. Hence, for example, the measurement of the deformations may be done by displacement capacitors (without contact) in their multiple variations (inductive, capacitive, etc.).

When the plate or beam (2) is in a totally horizontal position, the force produced by the coin and hence producing the flexion, will be its own weight ($F-m\times g$).

Figure 2:
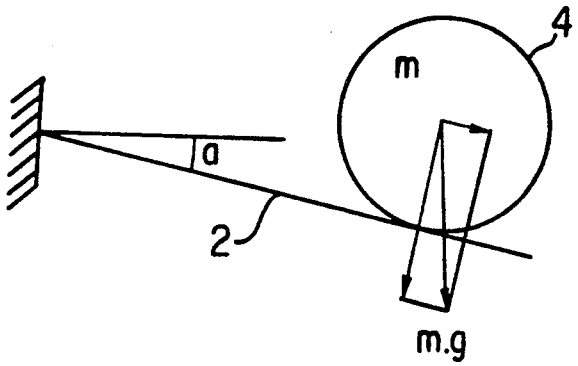
FIG. 2 shows a diagram of the force of the coin on the beam submitted to flexion.

If the plate is at an angle with the horizontal position, as seen in FIG. 2, the force provoking the flexion will be made up of the weight of the coin, in the normal direction of the plate ($F=m\times g\times \cos$ alfa).

In order to measure the deformation produced, it will be sufficient to attach an extensometer gage on the base of the plate, near the incasement, which is the most sensitive area. The gage may be arranged using auxiliary resistances or other gages, on a Wheastone bridges assembly (half or complete).

Using any of the typical signal condition circuits for Wheastone bridges, it is possible to obtain, at the circuit exit, an electric current related to the deformation experienced by the incased plate, as illustrated in FIG. 3. With a methodical analysis of this electric current, various mechanical characteristics of the coins could be determined.

For example, it could be possible to determine the volume of the coins, obtaining the principal component of the resulting electric signal. This signal will increase gradually until the coin goes beyond the end of the plate (2)m at which time it will return to the value indicated prior to the passing of the coin. FIG. 4 represents the electric current obtained as the coin passes; dO y dl corresponding to those of the beginning and end of the roll of the coin along the plate (2).

In this way it is also possible to calculate the volume of the coin by carrying out a frequency analysis of the electric signal obtained as, in addition to the principal component, (proportional to the weight of the coin), it is possible to find the correct frequency for the plate-coin unit. These frequencies will vary, depending on the coins inserted.

Finally, if the coin has a polygonal edge or the circular edge is ridged or fluted, it is possible to extract from the electric signal obtained, a component generated by the small vibrations produced by the edge of the coin as it rolls along the plate, therefore obtaining information about the shape of the coin.

Plate (2) may be supported at the free end or even encased at both ends, hence obtaining optimum flexion when the coin is halfway along the plate.

Plate (2) also allows shock absorbing material to be attached with the aim of filtering from the sensor, components of the electric signal obtained which are of a higher frequency than the basic and which are no longer required.

If the coin (4) should fall on sheet (2), it is possible to position a shock absorbing block in front of this sheet so as to deenergise the coin.

The beam or metallic strip will preferably be of metal, although it could also be made from non metallic materials, such as a composite base which is shock absorbing.

The beam represented in FIGS. 5 and 6 constitutes the upper route, reference marked 10, which defines the coin pathway, and a lower route number 11, which operated as an anchorage area for the beam to the body or housing unit of the selector.

The upper route (1) takes on the shape of flat C, the extreme ends 12 and 13 being of different length. Prolongation number 13 extends, from its free transversal edge to a first section (14) which is bent at 180° to the prolongation (13), and to a second section bent outwards at an angle slightly more than 90°, which defines the lower route (11). This portion has a series of holes (15) to allow the passing of rivets or anchorage elements of the beam to the body of the selector.

The prolongation 12 and 13 run at a certain inclination, downwards from the control stretch.

The central stretch of the beam will have a sensor or measurer of deformations (16) attached to the lower part.

FIGS. 7 and 8 show the internal part of a coin selector in which the beam (10), shown in FIGS. 5 and 6, is mounted.

FIGS. 7 reprents the stretch along which a coin (4), inserted into the selector, will follow. In front of the beam (10) is an anvil (18) on which the coin will fall which serves as a shock absorbing element against the impact vibrations. In this case, the sensor 16 incorporated in the beam (10), will detect only the deformations originating on the beam as a result of the rolling or displacement of the coin along the beam.

As can be seen from FIG. (8), the selector body has a lower stopper (19) and upper stopper (20) which limit the possibilities of oscilations or movements of the beam (10).

The remaining components shown in FIGS. 7 and 8 correspond to those of a traditional selector.

In the case of FIG. (9), the upper stretch of the beam is reference marked 10*a* and the lower stretch 11*a*. These two stretches are straight and converge on each other, remaining joined for an intermediate stretch (21) which is a prolongation and forms part of the tracts 10*a* and 11*a*, being perpendicular to the latter. Tract 10*a* will run along, as in the case of FIGS. 1 to 6, at an inclination so as to facilitate the rolling of the coins 17. The sensor 16 is attached to the external surface of the intermediate stretch 21.

The beam unit illustrated in FIG. 7 adopts a general form C. None of the extreme ends of the tract (10*a*), which make up the rolling pathway, are incased. The incasement is defined by the C base or lower tract 11*a*.

Finally, FIG. 10 represents a configuration of the beam in the form approximately of a T. The upper tract 10*b* and the lower tract 11*b* are straight and converge as in the case of FIG. 7 and continue joined for the length of the intermedoate tract 21*b* which forms part of the lower tract 11*b* and is independent from the upper tract 10*b* which determines the rolling pathway for coins (70). The intermediate tract 21*b* coincides at an intermediate point on the upper tract 10*b*, to which it is joined.

In this case, none of the extremes of the ramp 10*b* are incased. As in the case of FIG. 7, the lower tract 11*a* defines the incasement or attachment zones. The sensor 16 is attached to the external surface of the interemediate tract 21*b*. the signal obtained with this is symmetrical, with respect to the moment at which the coin passes over the intermediate tract 21*b*.

FIG. 4 corresponds to a diagram of the electric signal which ensues from the deformations of the elastically deformable element, shown in FIG. 1, in the form of beam 2 incased at one end, during the impact and rolling of the coin (4). The electrical current obtained is also shown in this diagram, where the references $t_0$ and $t_1$ correspond to the moment of commencement and completion of the rolling of the coin on the beam which makes up the deformable elastic element.

The detailed analysis of the signal represented in FIG. 4 enables one to clearly distinguish two perfectly differentiated fields by the dissimilar activation of both. Firstly, the signals produced by the deformation experienced in the beam, which constitutes the deformable elastic element, are detected at the moment of impact of the coin on the beam, precisely up to the moment when the rolling is about to begin. These signals correspond to the graph in FIG. 4, to those observed near the moment t0, the moment of impact, immediately before the commencement of the rolling. Once the coin begins to roll along the beam, the signals corresponding to the impact (instant t0) terminate and the vibrations which the coin beam unit produce begin to be activated by the rolling of the coin. The duration of these vibrations extends to the instant t1, in which the coin rolls along the sensored beam.

The invention uses the signals formely on, which in the graph of FIG. 4 correspond to those observed around the instant t0. By means of frequency analysis techniques the frequencies corresponding to the resonance in relation to the type of impact are analyzed, hence determining a parameter which is representative of the mechanical elasticity of the coin. For this purpose, as already indicated, the upper harmonics of the impact signal is measured, the content of this measurement being representative of the mechanical elasticity of the coin.

These characteristics can be seen in the graph of FIGS. 11 and 12 in the first of which the frequency content of a legal tender coin is shown. In the graph of FIG. 12, the frequency content of a fake coin these graph is detected in the spectrum near the frequency, indicated by the point $F_1$, corresponding to the moment of impact of the coin on the elastically deformable element.

As already indicated previously, a new parameter will be considered when carrying out a measurement of the frequency contents present on impact, depending on the mechanical elasticity of the coin, for their storage in the coin selector memory and their later help in identification, together with other parameters representative of the weight, alloy, dimensions, etc.

FIG. 13 corresponds to a block diagram of a circuit applicable to the frequency analysis of the impact previously described.

In this circuit, reference mark 4 indicates a coin which will impact on the elastically deformable element, to which the impact sensor 7, FIG. 1 is related. The level of the signal delivered by sensor 7 is amplified by a block amplifier 22. Following, is an analogic pitch-band filter circuit (23) the tuning of which is centered on the characteristic frequency $f_0$ of the elasticity sought after.

After the filter is an analog/digital converter 24, which will send the digital signal to a microprocessor (25) for processing, the filter (23) may be of fixed or variable pitch-band frequency, depending on whether one or various ranges of frequency are involved.

The memory (26), in which the parameters corresponding to different legal tender coins will be stored and which will assist in identification of the same, is connected to the microprosessor.

A digital filter can be used as an alternative to the analogic filter (23), incorporated in the microprocessor used in the coin selector.

When wishing to incorporate a measurement of the characteristics vibrations present during the rolling of the coin along the beam, in other words the instances $t_0$ through $t_1$ of FIG. 4, a circuit similar to that described in reference to FIG. 13 can be used, with the link reference marked 27.

Reference 28 indicates the admission/rejection and control of signal.

We claim:

1. An apparatus for detecting mechanical characteristics of coins in order to determine whether the coins are authentic, the apparatus comprising:

an elastically deformable element capable of being deformed by the weight of a coin, the element being in the form of a beam having a fixed portion and an overhanging portion;

said beam defining a rolling path along which a coin can travel, the beam being deformable by the rolling coin to an extent which depends on the weight of the coin and the position of the coin relative to the fixed portion of the beam; and the beam having means for measuring deformation of the beam as the coin travels therealong;

wherein the measuring means is for providing a signal based on the measured deformations that is representative of the mechanical elasticity of the coin which can be compared with stored data to determine whether or not the coin is authentic.

2. An apparatus according to claim 1, wherein said beam is made up of an elastic band which is fixed at one end while the other end is overhanging.

3. An apparatus according to claim 1, wherein the deformation measuring means consists of at least one extensometric gage attached to the beam near its fixed portion.

4. An apparatus according to claim 1, wherein the deformation measuring means consists of at least one displacement sensing device attached to the beam near its fixed portion.

5. An apparatus according to claim 2, wherein the beam is fixed at its overhanging portion.

6. An apparatus according to claim 1, wherein the beam is fixed at both ends.

7. An apparatus according to claim 1, wherein said beam comprises an upper tract, which defines the rolling path for the coins, and a lower tract which defines an anchoring zone for the unit to the body or housing unit of the selector; with the first tract running at an inclination in order to provoke the rolling of the coins.

8. An apparatus according to claim 7, wherein the upper tract adopts a configuration in the form of flat C, the arms of which are of different length, the longer prolongation extending to a first section which is bent at 180° under itself, and a second section bending outwards at an angle of slightly more than 90°, hence defining the lower anchorage tract, with the sensor being attached underneath the central arm of the upper tract.

9. An apparatus according to claim 7, wherein the upper and lower tracts are straight and converging, remaining joinend by their divergent extremes via an intermediate stretch which is a prolongation of both tracts, making up one single piece and is perpendicular to the lower anchorage tract, the sensor being attached laterally to the intermediate stretch.

10. An apparatus according to claim 7, wherein the upper and lower tracts are straight and converge and remain joined for a straight intermediate stretch which is a prolongation of the lower tract with which it forms an angle of 90°, coming together and joining underneath at an intermediate point of the upper stretch the sensor being attached laterally to the intermediate stretch.

11. An apparatus according to claim 1, wherein a shock absorbing member is disposed adjacent said beam for receiving a dropped coin and guiding the coin onto the beam.

12. An apparatus for determining the mechanical characteristics of coins, the apparatus comprising:

an elastic element capable of being deformed by the weight of a coin, the element being in the form of a beam having a fixed portion, said beam defining a rolling path along which a coin can travel and being deformable by the coin to an extent which depends on the weight of the coin and the position of the coin relative to the fixed portion of the beam;

the beam including an upper tract and a lower tract, the upper tract defining said rolling path and the lower tract defining said fixed portion, said upper tract being disposed at an inclination to facilitate rolling of the coin;

the upper tract being in the form of a flattened C shape with two arms of different length and a central section, the longer arm having a first section bent 180° under itself and a second section bent outwardly away from the central section at an angle of about 90° to form said lower tract; and the beam having means disposed on a side of the central section opposite said rolling path for sensing deformation of the beam.

13. An apparatus for determining the mechanical characteristics of coins, the apparatus comprising:

an elastic element capable of being deformed by the weight of a coin, the element being in the form of a beam having a fixed portion, said beam defining a rolling path along which a coin can travel and being deformable by the coin to an extent which depends on the weight of the coin and the position of the coin relative to the fixed portion of the beam;

the beam including an upper tract and a lower tract, the upper tract defining said rolling path and the lower tract defining said fixed portion, said upper tract being disposed at an inclination to facilitate rolling of the coin;

the upper tract and lower tract formed of a one-piece member with the lower tract extending substantially horizontal, an intermediate portion substantially perpendicular to and extending upward from the lower tract, and the upper tract extending from said intermediate portion at an inclination so as to converge with the lower tract;

the beam having means disposed on the intermediate portion for sensing deformation of the beam.

14. An apparatus for determining the mechanical characteristics of coins, the apparatus comprising:

an elastic element capable of being deformed by the weight of a coin, the element being in the form of a beam having a fixed portion, said beam defining a rolling path along which a coin can travel and being deformable by the coin to an extent which depends on the weight of the coin and the position of the coin relative to the fixed portion of the beam;

the beam including an upper tract and a lower tract, the upper tract defining said rolling path and the lower tract defining said fixed portion, said upper tract being disposed at an inclination to facilitate rolling of the coin;

the upper tract and lower tract converging and being connected by an intermediate portion that extends between the two tracts, the intermediate portion forming an extension of the lower tract that is substantially perpendicular thereto, said intermediate portion being joined to the upper tract at substantially the midpoint thereof; and the beam having means disposed on the intermediate portion for sensing deformation of the beam.

* * * * *